US009691539B2

(12) United States Patent
Kido et al.

(10) Patent No.: US 9,691,539 B2
(45) Date of Patent: Jun. 27, 2017

(54) COIL COMPONENT

(71) Applicant: MURATA MANUFACTURING CO., LTD., Kyoto-fu (JP)

(72) Inventors: Tomohiro Kido, Nagaokakyo (JP); Akinori Hamada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/175,368

(22) Filed: Jun. 7, 2016

(65) Prior Publication Data

US 2017/0004918 A1 Jan. 5, 2017

(30) Foreign Application Priority Data

Jun. 30, 2015 (JP) ..... 2015-130535

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/04*** | (2006.01) |

(52) U.S. Cl.

CPC ..... *H01F 27/2804* (2013.01); *H01F 5/00* (2013.01); *H01F 27/292* (2013.01); *H01F 41/041* (2013.01); *H01F 2027/2809* (2013.01)

(58) Field of Classification Search

CPC ..... H01F 5/00; H01F 27/00–27/30
USPC .... 336/65, 83, 192, 200, 220–223, 232–234
See application file for complete search history.

(56) References Cited

U.S. PATENT DOCUMENTS

| | | | | |
|---|---|---|---|---|
| 6,218,925 | B1 * | 4/2001 | Iwao | H01F 17/0013 336/200 |
| 6,977,573 | B1 * | 12/2005 | Maeda | H01F 5/003 336/200 |
| 2010/0253464 | A1 * | 10/2010 | Miyoshi | H01F 17/0013 336/200 |
| 2015/0371755 | A1 * | 12/2015 | Im | H01F 27/2804 336/200 |
| 2016/0372261 | A1 * | 12/2016 | Ozawa | H01F 17/0013 |

FOREIGN PATENT DOCUMENTS

| | | |
|---|---|---|
| JP | 05-036532 A | 2/1993 |

* cited by examiner

*Primary Examiner* — Tuyen Nguyen
(74) *Attorney, Agent, or Firm* — Studebaker & Brackett PC

(57) ABSTRACT

A coil conductor has a central axis extending in parallel with a mounting surface. The coil conductor disposed inside a component body extends substantially helically by alternately connecting a plurality of circulating conductive layers and a plurality of via hole conductors. The circulating conductive layers each extend so as to form a part of a substantially quadrangular track having a relatively short side and a relatively long side along an interface between the insulating layers. The via hole conductors each penetrate the insulating layer in a thickness direction. The line width of a short side portion of the circulating conductive layer is wider than that of a long side portion of the circulating conductive layer.

7 Claims, 8 Drawing Sheets

COIL COMPONENT

CROSS REFERENCE TO RELATED APPLICATIONS

This application claims benefit of priority to Japanese Patent Application 2015-130535 filed Jun. 30, 2015, the entire content of which is incorporated herein by reference.

TECHNICAL FIELD

The present disclosure relates to a coil component, and more specifically relates to a coil component that contains a coil conductor in a multilayer structure.

BACKGROUND

The present disclosure is interested in coil components that include a component body having a multilayer structure in which a plurality of insulating layers are laminated, and a coil conductor provided inside the component body. In the coil component, the coil conductor is constituted of a plurality of circulating conductive layers each extending so as to form a part of a substantially annular track along an interface between the insulating layers, and a plurality of via hole conductors each penetrating the insulating layer in a thickness direction. The coil conductor extends substantially helically by alternately connecting the circulating conductive layers and the via hole conductors.

For example, a narrow deviation and a high Q value are required of high frequency coils. In order to regulate an inductance (L) value of the coil components, there is known a method in which the line width of the coil conductor is finely adjusted, thereby varying the cross-sectional area of the inside of a coil.

On the other hand, it is inevitable that stray capacitance occurs in the coil conductor extending substantially helically, as described above, due to the potential difference between the circulating conductive layers opposite each other across one insulating layer in a lamination direction. Thus, the characteristics of the coil components have to be adjusted with consideration given to the stray capacitance.

However, the stray capacitance tends to vary according to variations in patterns of the circulating conductive layers and misalignment in lamination of the insulating layers. The variations in the stray capacitance result in variations in the characteristics, e.g. the self-resonant frequency of the coil components.

For example, Japanese Unexamined Patent Application Publication No. 5-36532 describes a technique for reducing the variations in the stray capacitance, as described above. According to the technique, the circulating conductive layers opposite each other in the lamination direction have different line widths. In other words, the line width of one of the opposite circulating conductive layers is wider than that of the other, so that even if the opposite circulating conductive layers vary in their patterns or the insulating layers are misaligned in lamination more or less, the opposite area of the pair of circulating conductive layers does not vary, thus reducing the variations in the stray capacitance. As a result, a coil component of Japanese Unexamined Patent Application Publication No. 5-36532 can reduce variations in the self-resonant frequency, and stably obtain high Q characteristics at high frequencies.

SUMMARY

Increasing the line width of the circulating conductive layers uniformly in the same layer plane, as described in Japanese Unexamined Patent Application Publication No. 5-36532, brings about a decrease in the cross-sectional area of the inside of the coil. Under circumstances where miniaturized or short height electronic components adding constraints to wiring space in a housing, however, when the line width of the circulating conductive layers is uniformly increased as described above, the L value and the Q value, which are susceptible to the cross-sectional area of the inside of the coil, significantly decrease.

On the other hand, uniformly decreasing the line width of the circulating conductive layers causes an increase in a resistance (R) value, thus resulting in a decrease in the Q value.

In addition, focusing attention on the via hole conductors each connecting the circulating conductive layers, even if the line width of the circulating conductive layers is decreased, via pads each formed at a connection portion of the circulating conductive layer with the via hole conductor have to be relatively wide, owing to process limitations on a hole diameter to form the via hole conductors and limitations on positional precision of the via hole conductors. Therefore, in a case where the line width of the circulating conductive layers is uniformly decreased, via pad areas become dominant in the cross-sectional area of the inside of the coil and the stray capacitance, and hence the effects described in Japanese Unexamined Patent Application Publication No. 5-36532 are hard to obtain.

Accordingly, it is an object of the present disclosure to provide a coil component that solves the above-described problems and obtains a higher inductance value and a higher Q value.

According to one embodiment of the present disclosure, a coil component includes a component body having a substantially rectangular parallelepiped shape having first and second main faces opposite each other, and first and second side faces opposite each other and first and second end faces opposite each other, each pair of which couples the first and second main faces, respectively. The side faces each have a substantially rectangular shape having long sides and short sides. The component body has a multilayer structure in which a plurality of insulating layers are laminated in a direction orthogonal to the side faces.

The coil component also includes a coil conductor disposed inside the component body. The coil conductor includes a plurality of circulating conductive layers each extending so as to form a part of a substantially annular track along an interface between the insulating layers and a plurality of via hole conductors each penetrating the insulating layer in a thickness direction. The coil conductor extends substantially helically by alternately connecting the circulating conductive layers and the via hole conductors.

The coil component further includes first and second external terminal electrodes formed in an outer surface of the component body. The first and second external terminal electrodes are electrically connected to one and the other ends of the coil conductor, respectively.

Also, the coil component is mounted such that the second main face faces a mounting surface of a circuit board, in such a posture that a central axis of the coil conductor extends in parallel with the mounting surface.

The coil component is characterized in that the circulating conductive layers include long side portions extending in the direction of the long sides of the side faces and short side portions extending in the direction of the short sides of the side faces, and the line width of the short side portions of the circulating conductive layers is wider than that of the long side portions of the circulating conductive layers.

Since the line width of the short side portions is wider than that of the long side portions, as described above, it is possible to further bring a shape of a cross-sectional area of the inside of the coil close to the shape of a substantially square (or a substantially perfect circle), and increase the line width of the circulating conductive layers only partly, but not entirely.

According to the other embodiment of the present disclosure, the circulating conductive layers preferably form an approximately quadrangular track having relatively short sides and relatively long sides. The long side portions of the circulating conductive layers form the long sides of the track, and the short side portions of the circulating conductive layers form the short sides of the track. This configuration serves to further bring the shape of a cross-sectional area of the inside of the coil close to the shape of a substantially square.

The circulating conductive layer is generally formed with a relatively wide via pad at a connection portion with the via hole conductor. According to the other embodiment of the present disclosure, when viewed through in the direction of the central axis of the coil conductor, every via pad is preferably situated so as to overlap the short side portion of the circulating conductive layer. Overlapping the via pads with the short side portions of the circulating conductive layers, which have the relatively wide line width, facilitates minimizing an increase in the stray capacitance.

According to the other embodiment of the present disclosure, the first and second external terminal electrodes are formed not in the first main face, but at least in areas of the second main face on the side of the first end face and on the side of the second end face, respectively. In other words, the external terminal electrodes are formed only in the second main face, which faces the mounting surface, or formed into the shape of the letter L so as to extend from the second main face to each of the first and second end faces.

According to this configuration, the coil component is necessarily mounted such that the second main face faces the mounting surface of the circuit board, in such a position that the central axis of the coil conductor extends in parallel with the mounting surface, as described above. In other words, the coil component is prohibited from being mounted in a wrong position, e.g. in a posture that the central axis of the coil conductor is perpendicular to the mounting surface.

When L represents the dimension of the long sides of the side faces and T represents the dimension of the short sides of the side faces, $T \leq L/2$ preferably holds true, and $T < L/2$ more preferably holds true. This configuration is adopted when the height of the coil component is shortened.

To make sure the effects of the embodiments of the present disclosure, it is preferable that the line width of the short side portions of the circulating conductive layers be 1.3 times or more and 2.7 times or less wider than the line width of the long side portions of the circulating conductive layers.

According to the coil component of the embodiments of the present disclosure, since the line width of the short side portions of the circulating conductive layers is wider than that of the long side portions thereof, as described above, the shape of the cross-sectional area of the inside of the coil is further brought close to the shape of a substantially square (or a substantially perfect circle), thus causing less interference of magnetic flux. That is to say, it is possible to obtain a high Q value, without much decreasing the acquisition efficiency of inductance.

Also, according to the coil component of the embodiments of the present disclosure, since the line width can be increased only at a part of the circulating conductive layers, instead of in the entire circulating conductive layers, as described above, it is possible to prevent an increase in resistance (R), thus resulting in preventing a decrease in the Q value.

Other features, elements, characteristics and advantages of the present disclosure will become more apparent from the following detailed description of the embodiments of the present disclosure with reference to the attached drawings.

BRIEF DESCRIPTION OF THE DRAWINGS

FIG. 4A shows the circulating conductive layers having a uniform line width as a reference, and FIGS. 4B to 4D show typical three modes A, B, and C of increasing the line width of the circulating conductive layers, respectively.

DETAILED DESCRIPTION

Figure 1:
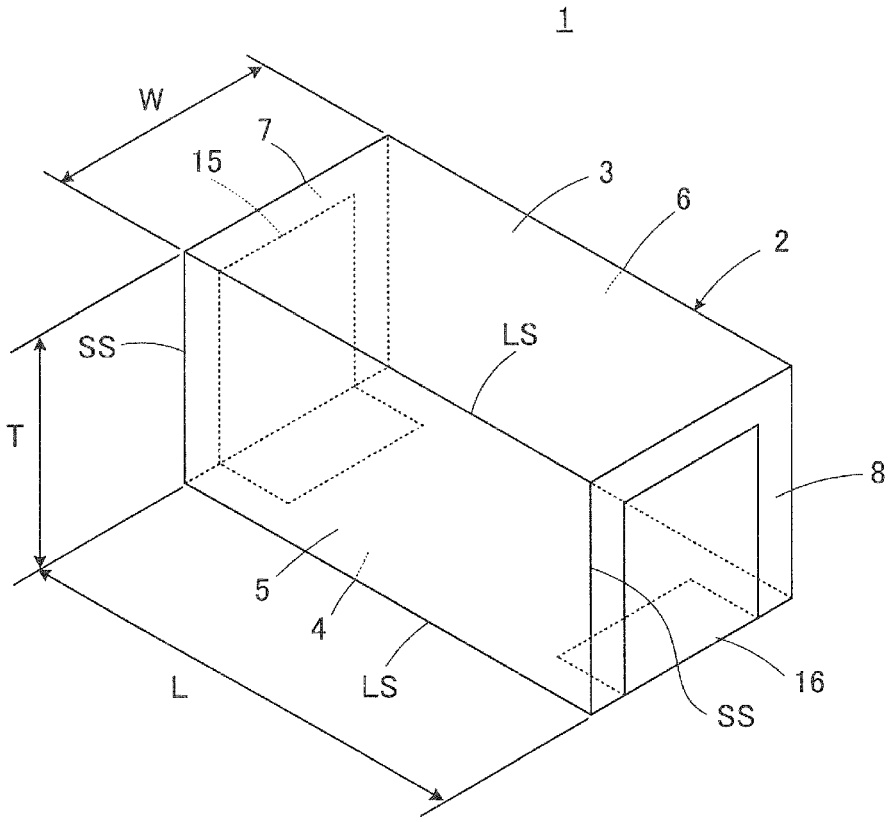
FIG. 1 is a perspective view of an outer appearance of a coil component according to a first embodiment of the present disclosure.

As shown in FIG. 1, a coil component 1 according to a first embodiment of the present disclosure includes a component body 2. The component body 2 has a substantially rectangular parallelepiped shape having first and second main faces 3 and 4 opposite each other, first and second side faces 5 and 6 opposite each other, and first and second end faces 7 and 8 opposite each other. Each pair of side faces 5 and 6 and end faces 7 and 8 couples the first and second main faces 3 and 4 together. More specifically, the side faces 5 and 6 each have a substantially rectangular shape having long sides LS and short sides SS.

Figure 2:
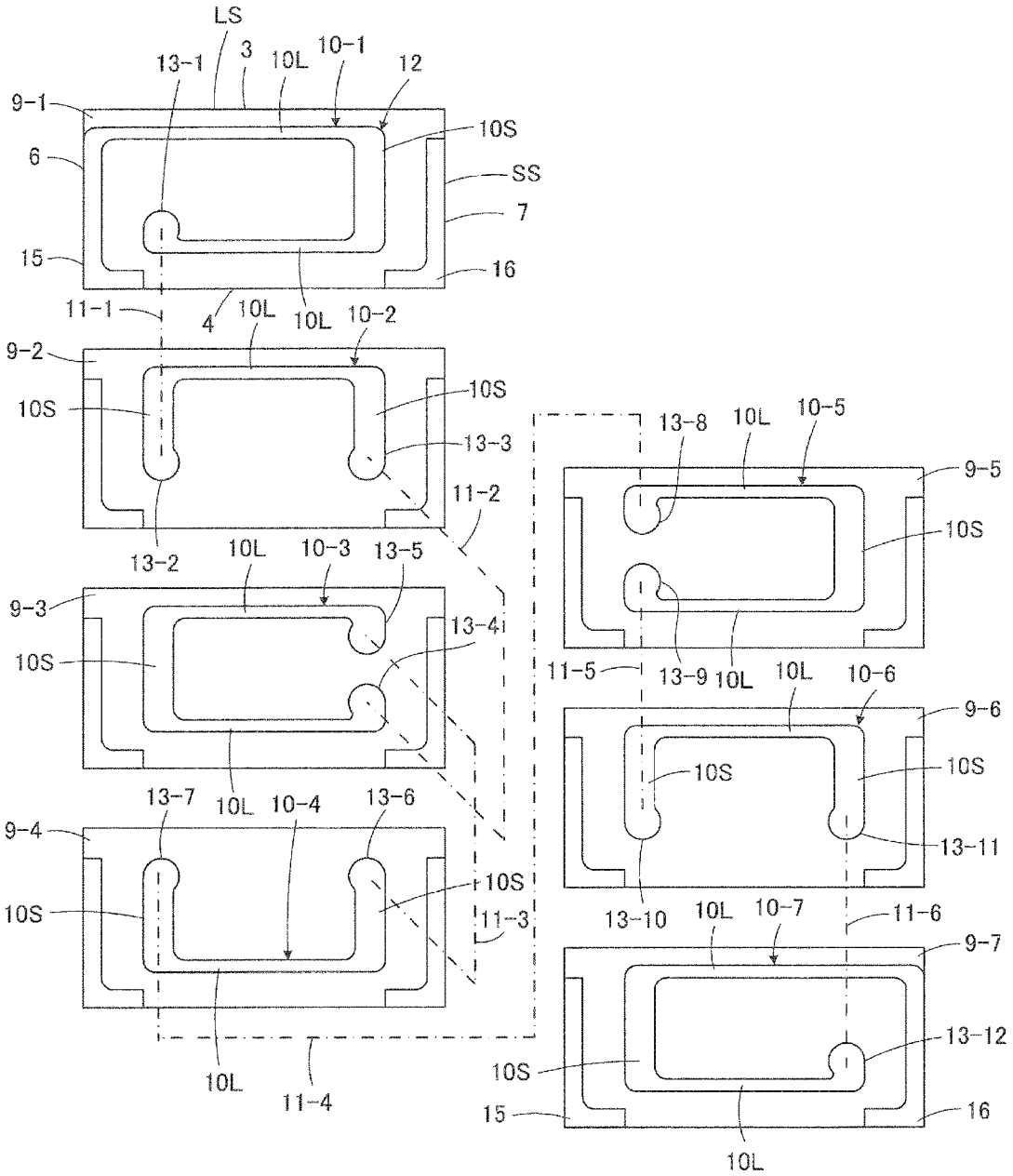
FIG. 2 is a plan view showing the coil component of FIG. 1 in an exploded manner.

The component body 2 has a multilayer structure in which a plurality of insulating layers including a plurality of insulating layers 9 shown in FIG. 2 are laminated. The insulating layers are laminated in a direction orthogonal to the side faces 5 and 6 (see FIG. 1). It is noted that in FIG. 2, the insulating layers are indicated with reference numerals of "9-1", "9-2", . . . , and "9-7", instead of just "9". The reference numerals of "9-1", "9-2", . . . , and "9-7" are used when there is the need for distinguishing the plurality of insulating layers from one another, while the reference numeral of "9" is used when there is no need for distinguishing the plurality of insulating layers.

In the component body 2, there is disposed a coil conductor 12 that extends substantially helically by alternately connecting a plurality of circulating conductive layers 10 and a plurality of via hole conductors 11. Each of the circulating conductive layers 10 extends so as to form a part of a substantially annular track along an interface between the insulating layers 9. Each of the via hole conductors 11 penetrates the insulating layer 9 in a thickness direction. The circulating conductive layers 10 are formed with relatively wide via pads 13 at connection portions with the via hole conductors 11. The reference numerals of the via hole conductors and the reference numerals of the via pads are intendedly used too, just as with the reference numerals of the insulating layers as described above.

To be more specific, the coil conductor 12 includes a circulating conductive layer 10-1, a via hole conductor 11-1, a circulating conductive layer 10-2, a via hole conductor 11-2, a circulating conductive layer 10-3, a via hole conductor 11-3, a circulating conductive layer 10-4, a via hole conductor 11-4, a circulating conductive layer 10-5, a via hole conductor 11-5, a circulating conductive layer 10-6, a via hole conductor 11-6, and a circulating conductive layer 10-7 that are connected in order.

In the coil conductor 12, the via hole conductor 11-1 is connected to the circulating conductive layer 10-1 through a via pad 13-1, and connected to the circulating conductive layer 10-2 through a via pad 13-2.

The via hole conductor 11-2 is connected to the circulating conductive layer 10-2 through a via pad 13-3, and connected to the circulating conductive layer 10-3 through a via pad 13-4.

The via hole conductor 11-3 is connected to the circulating conductive layer 10-3 through a via pad 13-5, and connected to the circulating conductive layer 10-4 through a via pad 13-6.

The via hole conductor 11-4 is connected to the circulating conductive layer 10-4 through a via pad 13-7, and connected to the circulating conductive layer 10-5 through a via pad 13-8.

The via hole conductor 11-5 is connected to the circulating conductive layer 10-5 through a via pad 13-9, and connected to the circulating conductive layer 10-6 through a via pad 13-10.

The via hole conductor 11-6 is connected to the circulating conductive layer 10-6 through a via pad 13-11, and connected to the circulating conductive layer 10-7 through a via pad 13-12.

The coil component 1 includes first and second external terminal electrodes 15 and 16. In this embodiment, as is apparent from FIG. 1, the first external terminal electrode 15 is formed so as to extend from an area of the second main face 4 on the side of the first end face 7 to the middle of the first end face 7. The second external terminal electrode 16 is formed so as to extend from an area of the second main face 4 on the side of the second end face 8 to the middle of the second end face 8. To put it briefly, the external terminal electrodes 15 and 16 each extend substantially in the shape of the letter L. In other words, the first and second external terminal electrodes 15 and 16 are not formed in the first main face 3.

The first external terminal electrode 15 is electrically connected to one end of the coil conductor 12, that is, one end of the circulating conductive layer 10-1. The second external terminal electrode 16 is electrically connected to the other end of the coil conductor 12, that is, one end of the circulating conductive layer 10-7.

The coil component 1 is mounted on a circuit board (not shown) so as to make a mounting surface of the second main face 4 face the circuit board. Thus, the direction of magnetic flux supplied by the coil conductor 12 is parallel with the mounting surface.

Figure 3:
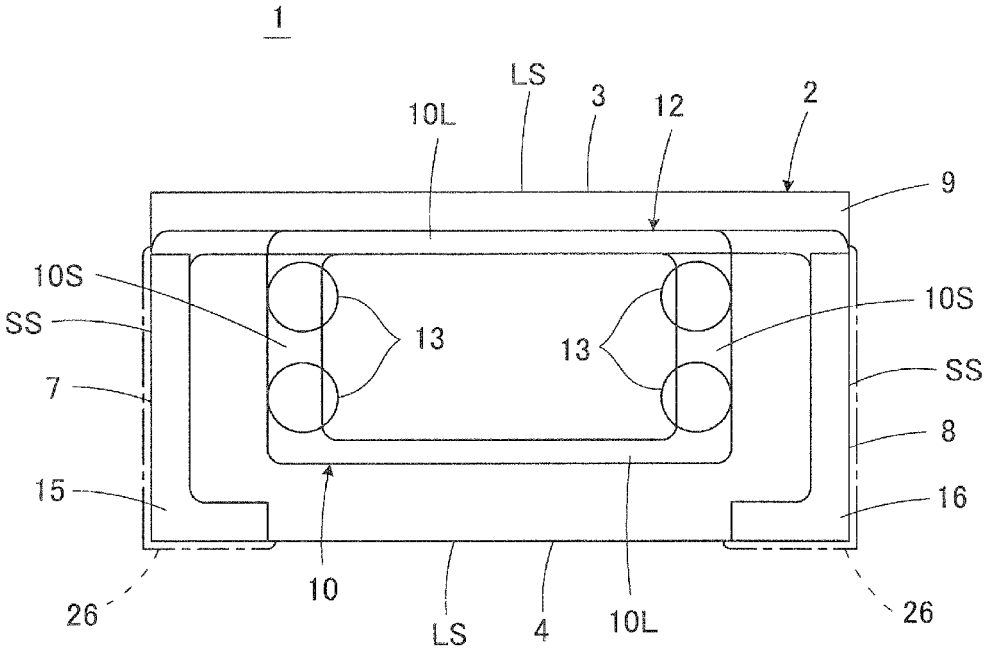
FIG. 3 is a drawing showing the coil component of FIG. 1 in a see-through manner in the direction of a central axis of a coil conductor.

In such a coil component 1, the following configuration characterizes this embodiment. The configuration that characterizes this embodiment will be described with reference to FIGS. 2 and 3. FIG. 3 is a drawing in which the coil component 1 is shown in a see-through manner in the direction of a central axis of the coil conductor 12. FIG. 3 shows a plurality of components included in the coil component 1 in an overlapped manner.

As shown in FIGS. 2 and 3, the circulating conductive layers 10 included in the coil component 1 have long side portions 10L extending in the direction of the long sides LS of the side faces 5 and 6 (see FIG. 1) of the component body 2 and short side portions 10S extending in the direction of the short sides SS of the side faces 5 and 6 of the component body 2. The line width of the short side portions 10S is wider than that of the long side portions 10L.

Specifically, in this embodiment, the circulating conductive layers 10 form an approximately rectangular track having relatively short sides and relatively long sides. The long side portions 10L of the circulating conductive layers 10 form the long sides of the track. The short side portions 10S of the circulating conductive layers 10 form the short sides of the track.

Such a configuration serves to further bring the shape of the cross-sectional area of the inside of the coil close to the shape of a substantially square.

When viewed through in the direction of the central axis of the coil conductor 12, every via pad 13 is situated so as to overlap the short side portion 10S of the circulating conductive layer 10. Since the relatively wide via pads 13 overlap the short side portions 10S, which originally have the relatively wide line width, of the circulating conductive layers 10, as described above, an increase in stray capacitance is minimized.

Next, the results of simulations to realize the effects of the present disclosure will be described.

Figure 4A:
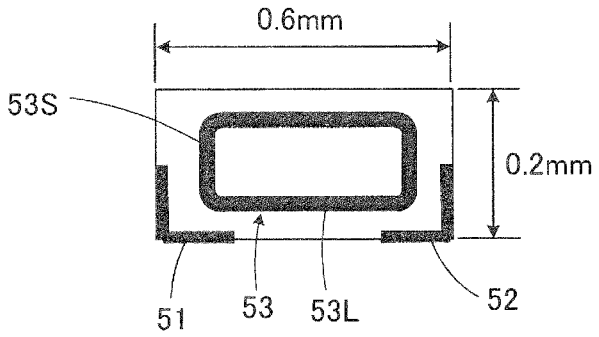
FIGS. 4A to 4D are schematic drawings of first and second external terminal electrodes and circulating conductive layers of the coil conductor.

As shown in FIG. 4A as a reference, in coil components used in the simulations, a side face of a component body has a long side length of 0.6 mm, a short side length of 0.2 mm, a depth of 0.3 mm in a direction orthogonal to the drawing of FIG. 4A, and an L value of 5 to 6 nH.

Figure 4B:
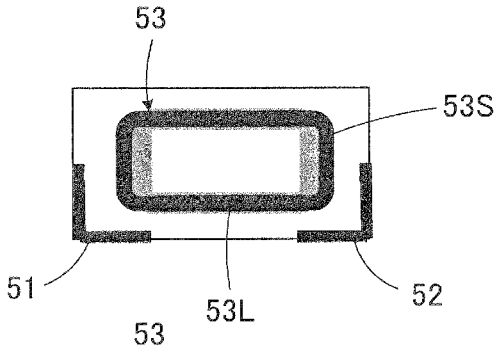
Figure 4C:
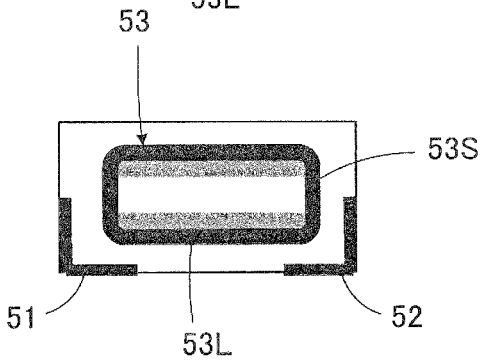
Figure 4D:
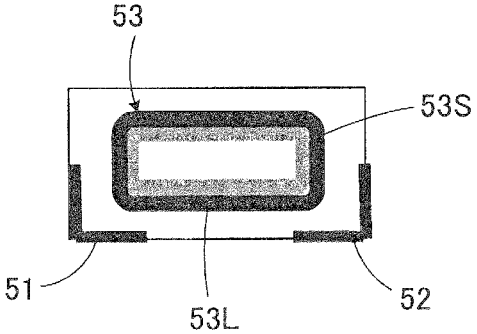

FIGS. 4A to 4D schematically show first and second external terminal electrodes 51 and 52 and circulating conductive layers 53 of a coil conductor provided in the coil components used in the simulations. In FIG. 4A, the circulating conductive layers 53 have a uniform line width, as the reference. FIGS. 4B to 4D show the cases of increasing the line width of the circulating conductive layers 53, as typical three modes A to C.

Figure 5A:
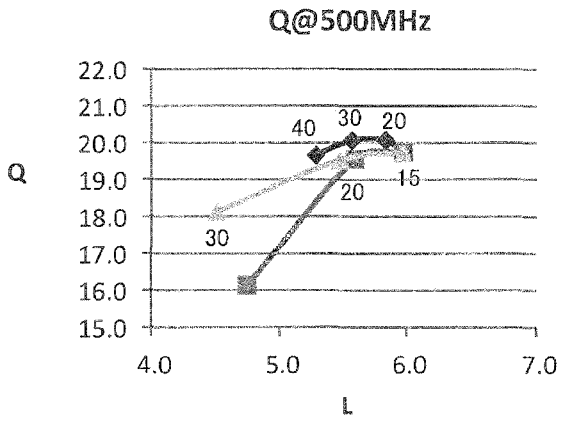
FIGS. 5A to 5C are graphs of L-Q characteristics as simulation results at frequencies of 500 MHz, 1 GHz, and 2 GHz, respectively, as to the typical three modes A, B, and C of increasing the line width of the circulating conductive layers shown in FIGS. 4B to 4D.
Figure 5B:
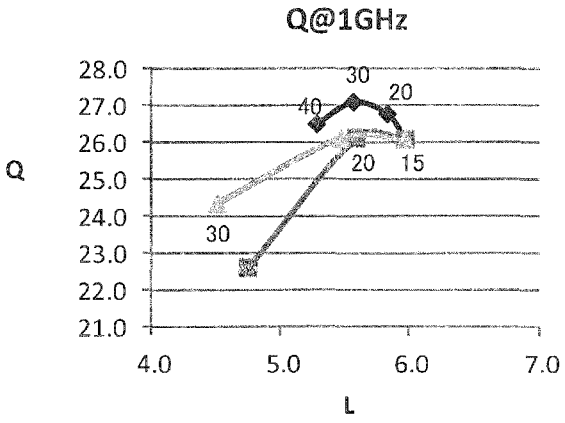
Figure 5C:
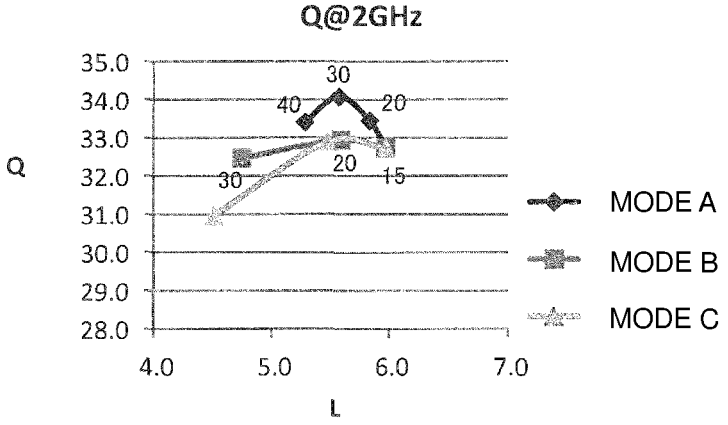

FIGS. 5A to 5C show the simulation results of L-Q characteristics at frequencies of about 500 MHz, 1 GHz, and 2 GHz, respectively, in the typical three modes A to C of increasing the line width of the circulating conductive layers 53 as shown in FIGS. 4B to 4D.

More specifically, FIG. 4B shows the mode A in which the line width of the circulating conductive layers 53 is increased at short side portions 53S. FIG. 4C shows the mode B in which the line width of the circulating conductive layers 53 is increased at long side portions 53L. FIG. 4D shows the mode C in which the line width of the circulating conductive layers 53 is increased at both the short side portions 53S and the long side portions 53L.

In the simulations, the circulating conductive layers 53 had a uniform line width of about 15 μm in the reference shown in FIG. 4A. In FIG. 4B, on the other hand, the line width of the circulating conductive layers 53 was increased to about 20 μm, 30 μm, and 40 μm at the short side portions 53S. In FIG. 4C, the line width of the circulating conductive layers 53 was increased to about 20 μm and 30 μm at the long side portions 53L. In FIG. 4D, the line width of the circulating conductive layers 53 was increased to about 20 μm and 30 μm at both the short side portions 53S and the long side portions 53L.

Numbers "15", "20", "30", and "40" shown in the vicinity of plotted points in the line graphs of the L-Q characteristics of FIGS. 5A to 5C indicate the above-described line widths in the unit μm. The points indicated with the line width of "15" represent the L-Q characteristics of the "reference" coil component shown in FIG. 4A. It is noted that the reason why the line width of the circulating conductive layers is increased up to about 30 μm in the modes B and C is that an increase in the line width to about 40 μm brought about significant decreases in L and Q values.

First, the L-Q characteristics at the frequency of about 500 MHz will be explained with reference to FIG. 5A.

According to the L-Q characteristics of the mode A in which the line width of the circulating conductive layers 53 was increased at the short side portions 53S, when the line width was about 20 μm, 30 μm, or 40 μm, the Q value was similar to or more than that of the reference having the line width of 15 μm, while the L value did not much decrease.

On the other hand, according to the L-Q characteristics of the mode B in which the line width of the circulating conductive layers 53 was increased at the long side portions 53L, when the line width was increased to 30 μm, the L value and the Q value much decreased owing to interference of the magnetic flux, as compared with those of the reference.

Also, according to the L-Q characteristics of the mode C in which the line width of the circulating conductive layers 53 was increased at both the short side portions 53S and the long side portions 53L, when the line width was increased to 30 μm, the L value and the Q value much decreased owing to the interference of the magnetic flux, as compared with those of the reference.

Next, the L-Q characteristics at the frequency of about 1 GHz will be explained with reference to FIG. 5B.

According to the L-Q characteristics of the mode A in which the line width of the circulating conductive layers 53 was increased at the short side portions 53S, when the line width was about 20 μm, 30 μm, or 40 μm, the Q value was more than that of the reference having the line width of 15 μm, while the L value did not much decrease.

On the other hand, according to the L-Q characteristics of the mode B in which the line width of the circulating conductive layers 53 was increased at the long side portions 53L, when the line width was increased to 30 μm, the L value and the Q value much decreased owing to the interference of the magnetic flux, as compared with those of the reference.

Also, according to the L-Q characteristics of the mode C in which the line width of the circulating conductive layers 53 was increased at both the short side portions 53S and the long side portions 53L, when the line width was increased to 30 μm, the L value and the Q value much decreased owing to the interference of the magnetic flux, as compared with those of the reference.

Next, the L-Q characteristics at the frequency of about 2 GHz will be explained with reference to FIG. 5C.

According to the L-Q characteristics of the mode A in which the line width of the circulating conductive layers 53 was increased at the short side portions 53S, when the line width was about 20 μm, 30 μm, or 40 μm, the Q value was more than that of the reference having the line width of 15 μm, while the L value did not much decrease.

On the other hand, according to the L-Q characteristics of the mode B in which the line width of the circulating conductive layers 53 was increased at the long side portions 53L, as the line width was increased to 20 μm and 30 μm, the L value in particular decreased owing to the interference of the magnetic flux, as compared with that of the reference.

Also, according to the L-Q characteristics of the mode C in which the line width of the circulating conductive layers was increased at both the short side portions 53S and the long side portions 53L, when the line width was increased to 30 μm, the L value and the Q value much decreased as compared with those of the reference, owing to the interference of the magnetic flux and the effect of an increase in the stray capacitance at the high frequency.

The coil components 1 described with the reference to FIGS. 1 to 3 are preferably manufactured as follows. A manufacturing process will be described with reference to FIGS. 6A to 6C.

Figure 6A:
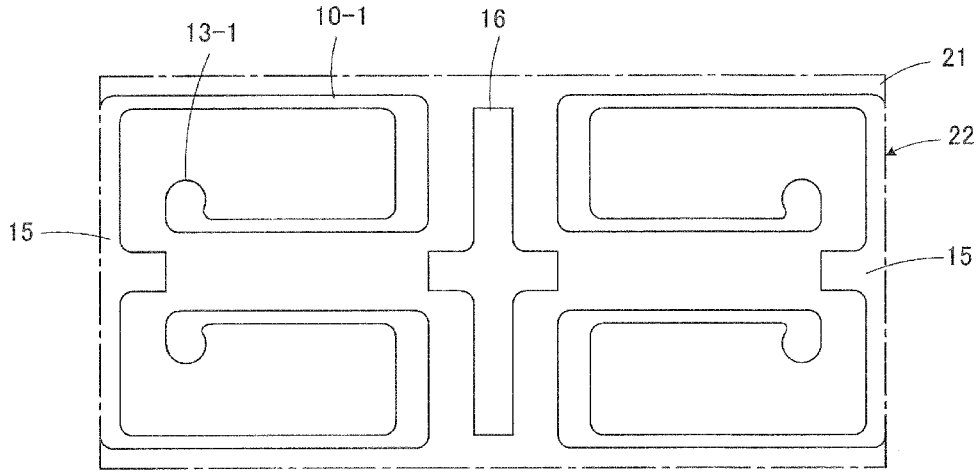
FIGS. 6A to 6C are drawings that explain a method for manufacturing the coil component shown in FIG. 1.

1.An insulating paste layer 21 as shown in FIG. 6A is formed by repeatedly applying an insulating paste having, for example, borosilicate glass as a main ingredient by screen printing. The insulating paste layer 21 is supposed to be the insulating layer 9-1 shown in FIG. 2, which composes one of the external layers.

2.A photosensitive conductive paste layer 22 is applied onto the insulating paste layer 21. The photosensitive conductive paste layer 22 is patterned by photolithography into the circulating conductive layers 10-1 having the via pads 13-1, the first external terminal electrodes 15, and the second external terminal electrodes 16, as also shown in FIG. 6A.

To be more specific, for example, a material having Ag as a main ingredient is used as a photosensitive conductive paste. The photosensitive conductive paste is applied by screen printing to form the photosensitive conductive paste layer 22. After that, the photosensitive conductive paste layer 22 is exposed to ultraviolet light or the like through a photomask, and developed with an alkaline solution or the like.

In this manner, the patterned photosensitive conductive paste layer 22 is obtained as shown in FIG. 6A.

Figure 6B:
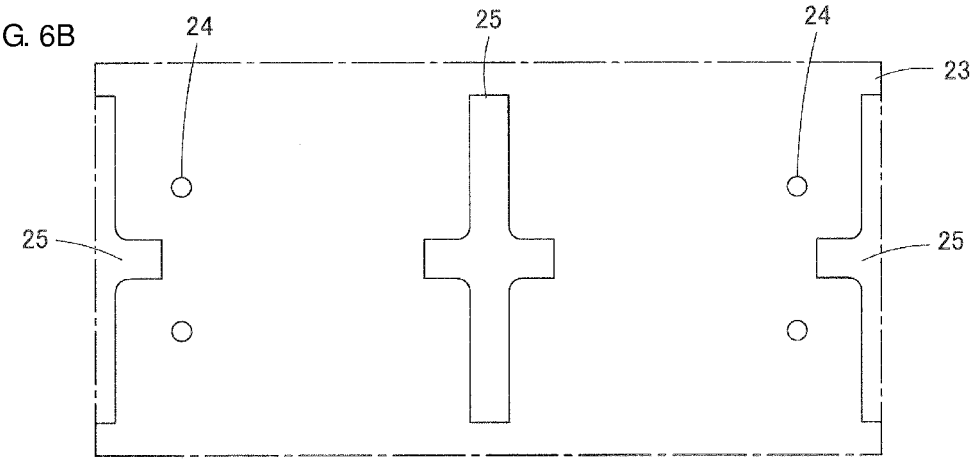

3. Another insulating paste layer 23 is formed over the insulating paste layer 21 as shown in FIG. 6B.

To be more specific, a photosensitive insulating paste is applied over the insulating paste layer 21 by screen printing to form the insulating paste layer 23. After that, the insulating paste layer 23 made of the photosensitive insulating paste is exposed to ultraviolet light or the like through a photomask, and developed with an alkaline solution or the like, so as to thereby form circular holes 24 to make the via hole conductors 11-1 and cross holes 25 to make the external terminal electrodes 15 and 16, as shown in FIG. 6B.

The insulating paste layer 23 is supposed to be the insulating layer 9-2 shown in FIG. 2.

Figure 6C:
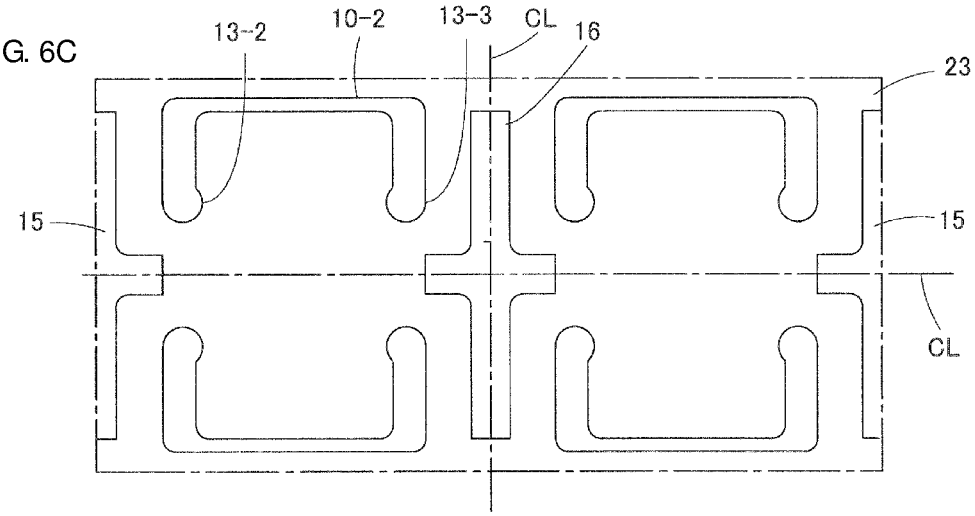

4.As shown in FIG. 6C, the circulating conductive layers 10-2 having the via pads 13-2 and 13-3 and the external terminal electrodes 15 and 16 are formed by photolithography, and the via hole conductors 11-1 shown in FIG. 2 are formed.

To be more specific, for example, a photosensitive conductive paste having Ag as a main ingredient is applied by screen printing to form a photosensitive conductive paste layer. At this time, the circular holes 24 and the cross holes 25 are filled with the photosensitive conductive paste. After that, the photosensitive conductive paste layer is exposed to ultraviolet light or the like through a photomask, and developed with an alkaline solution or the like.

Thus, the via hole conductors 11-1 are formed in the circular holes 24, and the external terminal electrodes 15 and 16 are formed in the cross holes 25. The circulating conductive layers 10-2 are formed on the insulating paste layer 23.

5. After that, by repetitions of steps similar to the above steps 3 and 4, the circulating conductive layers 10-3 to 10-7, the via hole conductors 11-2 to 11-6, and the external terminal electrodes 15 and 16 are formed, while the insulating paste layers, which are supposed to be the insulating layers 9-3 to 9-7, are formed sequentially. At last, the step of forming an insulating paste layer that is supposed to be an insulating layer to compose another of the external layers is carried out to obtain a mother multilayer body.

6.The mother multilayer body is cut with a dicing machine or the like to obtain a plurality of unfired component bodies. FIG. 6C shows the positions of cut lines CL to be used in a cutting step of the mother multilayer body. As is apparent from the positions of the cut lines CL, the external terminal electrodes 15 and 16 are exposed at cut surfaces obtained by the cutting step.

7.The unfired component bodies are fired under predetermined conditions, thereby obtaining the component bodies 2. The component bodies 2 are subjected to, for example, barrel polishing.

8. The coil components 1 are completed as described above. Plating films 26 are formed as necessary at portions of the external terminal electrodes 15 and 16 exposed from the component body 2, as shown by imaginary lines in FIG. 3. The plating films 26 are made of, for example, a Ni metal layer having a thickness of about 2 μm to 10 μm and a Sn metal layer having a thickness of 2 μm to 10 μm formed thereon.

A method for forming the conductive patterns performed in the above steps 2, 4, and the like is not limited to the lithography, as described above. For example, a printing lamination process of a conductive paste using a screen plate opened in the shape of a conductive pattern, a patterning process of a conductive film formed by sputtering, vapor deposition, pressure bonding of foil, or the like by etching, or a process such as a semi-additive process in which a conductive pattern is formed of a plating film using a negative pattern and then unnecessary portions are removed therefrom may be used instead.

A conductive material is not limited to Ag as described above, but may be another good conductor such as Cu, Au, or the like. The application method of the conductive material is not limited to pasting, but may be sputtering, vapor deposition, pressure bonding of foil, plating, or the like.

To form the insulating paste layer in the above steps 1 and 3, pressure bonding of an insulating material sheet, spin coating, spraying, or the like may be used. To form the circular holes 24 and the cross holes 25 in the above step 3, a method using a laser or drilling may be used.

An insulating material contained in the insulating layer 9 is not limited to glass or ceramics, but may be, for example, a resin material such as an epoxy resin or a fluorine resin, or a composite material such as a glass epoxy resin. It is noted that the insulating material preferably has a low permittivity and a low dielectric loss.

In the above step 8, after the external terminal electrodes 15 and 16 are exposed by cutting, the plating film 26 is formed. However, being not limited to this, after the external terminal electrodes 15 and 16 are exposed by cutting, a conductive paste may be applied or a metal film may be formed by sputtering or the like, and thereafter a plating process may be performed.

Figure 7:
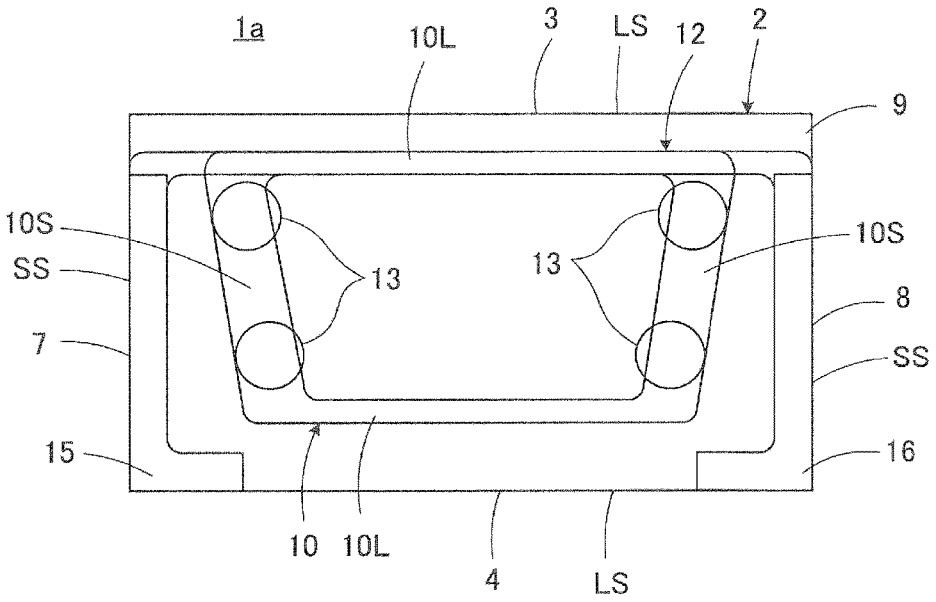
FIG. 7 is a drawing corresponding to FIG. 3 that shows a coil component according to a second embodiment of the present disclosure.

Next, a coil component 1*a* according to a second embodiment of the present disclosure will be described with reference to FIG. 7. FIG. 7 shows the coil component 1*a* in the same manner as FIG. 3. In FIG. 7, the same reference numerals as in FIG. 3 indicate identical or similar components to those in FIG. 3, and the description thereof will be omitted.

In the coil component 1*a* shown in FIG. 7, the circulating conductive layers 10 form an approximately quadrangular track, just as in the case of the coil component 1 described above. The coil component 1*a* is characterized in that the two long side portions 10L have different lengths from each other.

Such a coil component 1*a* serves to increase the cross-sectional area of the inside of the coil, while avoiding interference with the external terminal electrodes 15 and 16.

Figure 8:
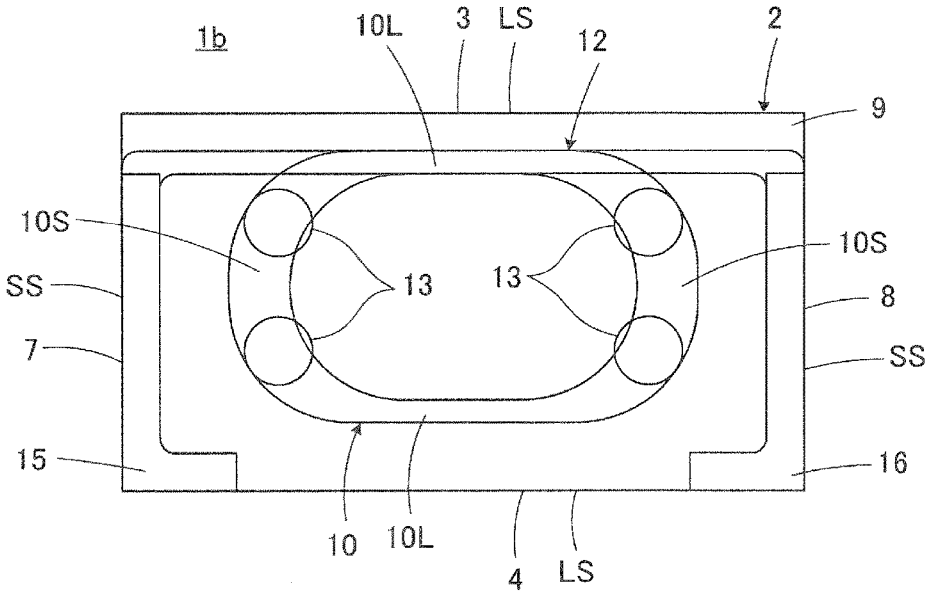
FIG. 8 is a drawing corresponding to FIG. 3 that shows a coil component according to a third embodiment of the present disclosure.

Next, a coil component 1*b* according to a third embodiment of the present disclosure will be described with reference to FIG. 8. FIG. 8 shows the coil component 1*b* in the same manner as FIG. 3. In FIG. 8, the same reference numerals as in FIG. 3 indicate identical or similar components to those in FIG. 3, and the description thereof will be omitted.

The coil component 1*b* shown in FIG. 8 is characterized in that the circulating conductive layers 10 form a substantially oblong circular track, and the line width of the short side portions 10S extending along the short sides SS of the side faces 5 and 6 (see FIG. 1) of the component body 2 is wider than that of the long side portions 10L extending along the long sides LS of the side faces 5 and 6.

The dimensions of each of the above-described coil components 1, la, and 1*b* are not specifically limited. However, when the dimensions are represented by L×W×T according to dimensions L, W, and T shown in FIG. 1, each of the coil components 1, 1*a*, and 1*b* intends to satisfy T=L/2, such that 0.4 mm×0.2 mm×0.2 mm, or 0.6 mm×0.3 mm×0.3 mm.

In contrast, coil components are sometimes desired to be shorter in height, such that L×W×T is 0.6 mm×0.3 mm×0.2 mm, 0.6 mm×0.3 mm×0.25 mm, 0.4 mm×0.2 mm×0.15 mm, or 0.4 mm×0.2 mm×0.1 mm.

Figure 9:
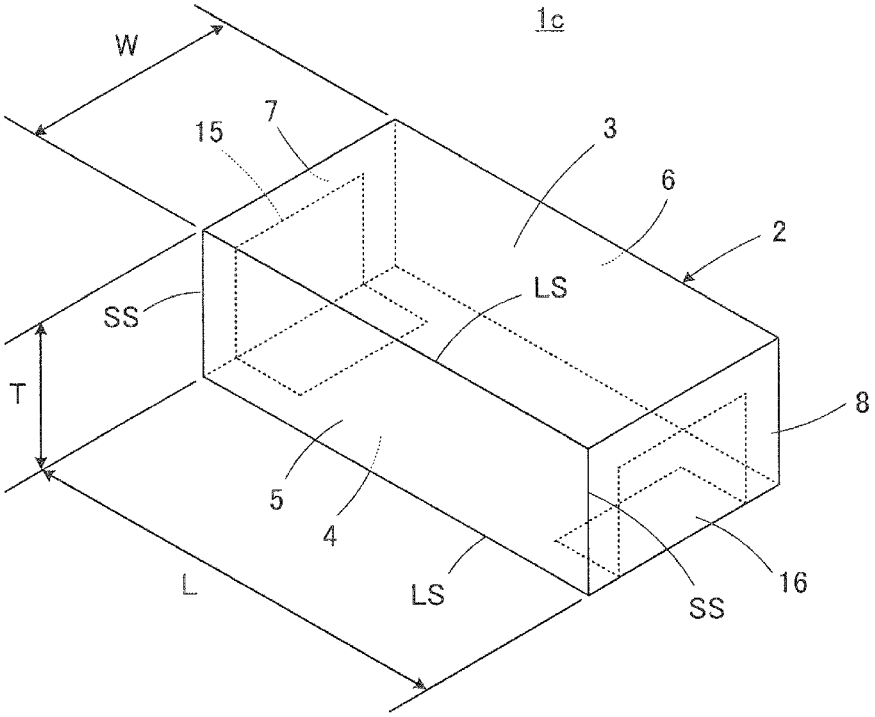
FIG. 9 is a perspective view of an outer appearance of a coil component according to a fourth embodiment of the present disclosure.

FIG. 9 is a perspective view of the outer appearance of a coil component 1*c* according to a fourth embodiment of the present disclosure, which is proposed in the background as described above. In FIG. 9, the same reference numerals as in FIG. 1 indicate identical or similar components to those in FIG. 1, and the description thereof will be omitted.

In the coil component 1*c* shown in FIG. 9, when L represents the length of the long sides LS of the side faces 5 and 6 and S represents the length of the short sides SS thereof, T<L/2 holds true. Since coil components used in portable communication devices such as smart phones are strongly desired to be short in height, the short height coil components 1*c* having a dimension ratio of T<L/2 as shown in FIG. 9 are preferably used.

On the other hand, it is difficult for the short height coil component 1*c* satisfying T<L/2 to bring the shape of the cross-sectional area of the inside of the coil close to the shape of a substantially square or a substantially perfect circle, and thus the interference of the magnetic flux tends to occur, therefore causing the disadvantages of reduced acquisition efficiency of L and a reduced Q value.

However, the characteristic configuration of the present disclosure in which the line width of the short side portions of the circulating conductive layers is wider than that of the long side portions serves to further reduce the above-described disadvantages. Therefore, the present disclosure is more effective when being specifically applied to the short height coil components.

The present disclosure has been described above as related to the several embodiments shown in the drawings, but other various modifications may be made within the scope of the present disclosure. For example, the circulating conductive layers 10 may form an elliptical track, instead of the rectangular or oblong circular track. The external terminal electrodes 15 and 16 may extend to the first main face 3 or may be formed only in the second main face 4.

Each of the embodiments described in this application is just an example, and the configurations may be partly substituted or combined between the different embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a component body having a rectangular parallelepiped shape having first and second main faces opposite each other, and first and second side faces opposite each other and first and second end faces opposite each other, each pair of which couples the first and second main faces, respectively, the side faces each having a rectangular shape having long sides and short sides, the component body having a multilayer structure in which a plurality of insulating layers are laminated in a direction orthogonal to the side faces;

a coil conductor disposed inside the component body, the coil conductor including a plurality of circulating conductive layers each extending so as to form a part of an annular track along an interface between the insulating layers and a plurality of via hole conductors each penetrating the insulating layer in a thickness direction, the coil conductor extending helically by alternately connecting the circulating conductive layers and the via hole conductors; and first and second external terminal electrodes formed in an outer surface of the component body, the first and second external terminal electrodes being electrically connected to one and the other ends of the coil conductor, respectively, wherein the coil component is mounted such that the second main face faces a mounting surface of a circuit board, in such a posture that a central axis of the coil conductor extends in parallel with the mounting surface, the circulating conductive layer includes a long side portion extending in a direction of the long sides of the side faces and a short side portion extending in a direction of the short sides of the side faces, and a line width of the short side portion of the circulating conductive layer is wider than that of the long side portion of the circulating conductive layer.

2. The coil component according to claim 1, wherein the track formed by the circulating conductive layers has a substantially quadrangular shape having a relatively short side and a relatively long side, the long side portion of the circulating conductive layer forms the long side of the track, and the short side portion of the circulating conductive layer forms the short side of the track.

3. The coil component according to claim 1, wherein the circulating conductive layer is formed with a relatively wide via pad at a connection portion with the via hole conductor, and when viewed through in a direction of the central axis of the coil conductor, every via pad is situated so as to overlap the short side portion of the circulating conductive layer.

4. The coil component according to claim 1, wherein the first and second external terminal electrodes are formed not in the first main face, but at least in areas of the second main face on the side of the first end face and on the side of the second end face, respectively.

5. The coil component according to claim 1, wherein $TL/2$ holds true, wherein L represents a dimension of the long sides of the side faces, and T represents the dimension of the short sides of the side faces.

6. The coil component according to claim 1, wherein $T<L/2$ holds true, wherein L represents the dimension of the long sides of the side faces, and T represents a dimension of the short sides of the side faces.

7. The coil component according to claim 1, wherein the line width of the short side portion of the circulating conductive layer is 1.3 times or more and 2.7 times or less wider than a line width of the long side portion of the circulating conductive layer.

* * * * *